US010737810B2

(12) United States Patent
Franke et al.

(10) Patent No.: US 10,737,810 B2
(45) Date of Patent: Aug. 11, 2020

(54) DEVICE AND METHOD FOR FILLING NESTED CONTAINERS

(71) Applicant: Groninger & Co. GmbH, Crailsheim (DE)

(72) Inventors: Bernd Franke, Wallhausen (DE); Josef Veile, Westhausen (DE)

(73) Assignee: GRONINGER & CO. GMBH, Crailsheim (DE)

( * ) Notice: Subject to any disclaimer, the term of this patent is extended or adjusted under 35 U.S.C. 154(b) by 327 days.

(21) Appl. No.: 15/858,737

(22) Filed: Dec. 29, 2017

(65) Prior Publication Data

US 2018/0186481 A1 Jul. 5, 2018

(30) Foreign Application Priority Data

Jan. 2, 2017 (DE) ..... 10 2017 100 010

(51) Int. Cl.
*B65B 3/26* (2006.01)
*B65B 3/28* (2006.01)
(Continued)

(52) U.S. Cl.
CPC ..... *B65B 3/28* (2013.01); *B65B 1/46* (2013.01); *B65B 3/003* (2013.01); *B65B 3/006* (2013.01);
(Continued)

(58) Field of Classification Search
CPC .. B65B 3/28; B65B 3/003; B65B 1/46; G01G 15/00
See application file for complete search history.

(56) References Cited

U.S. PATENT DOCUMENTS 5,806,287 A * 9/1998 Trechsel ..... G01G 15/001 177/52
8,689,525 B2 * 4/2014 Monti ..... B65B 3/003 53/281
(Continued)

FOREIGN PATENT DOCUMENTS

DE 102004035061 A1 2/2006
DE 102005026986 A1 12/2006
(Continued)

OTHER PUBLICATIONS

Search Report issued for the application EP 17207888.3 dated Apr. 10, 2018.

*Primary Examiner* — Reinaldo Sanchez-Medina
(74) *Attorney, Agent, or Firm* — Reising Ethington, P.C.

(57) ABSTRACT

A filling device for filling nested containers, which are arranged in at least one row in a nest and are conveyable by means of a conveying device, having a filling station for simultaneously filling the containers of one row, having at least one weighing station for weighing a row of containers, having a first gripping device for simultaneously removing a row of containers to be filled and for transferring said containers to a first weighing station of the at least one weighing station and for transferring the weighed containers from the at least one weighing station back into the nest or into a different nest. The filling device additionally comprises a second gripping device, for simultaneously removing the row of filled and weighed containers and for transferring said containers to the first weighing station or to a second weighing station of the at least one weighing station and for transferring the row of filled and twice weighed containers from the at least one weighing station back into the nest or into a different nest.

19 Claims, 4 Drawing Sheets

(51) Int. Cl.

| | |
|---|---|
| ***B65B 3/00*** | (2006.01) |
| ***B65B 7/28*** | (2006.01) |
| ***B65B 35/36*** | (2006.01) |
| ***B65B 43/46*** | (2006.01) |
| ***B65B 43/54*** | (2006.01) |
| ***B65B 1/46*** | (2006.01) |
| ***B65B 3/04*** | (2006.01) |

(52) U.S. Cl.
CPC ..... *B65B 3/04* (2013.01); *B65B 7/28* (2013.01); *B65B 35/36* (2013.01); *B65B 43/46* (2013.01); *B65B 43/54* (2013.01)

(56) References Cited

U.S. PATENT DOCUMENTS

| | | | | |
|---|---|---|---|---|
| 8,769,913 | B2 * | 7/2014 | Monti | A61M 5/008 53/148 |
| 9,493,254 | B2 * | 11/2016 | Boira Bonhora | G01G 17/00 |
| 9,796,489 | B2 * | 10/2017 | Veile | B65B 43/42 |
| 2005/0060962 | A1 * | 3/2005 | Rothbauer | B65B 3/003 53/471 |
| 2006/0191240 | A1 * | 8/2006 | Rothbauer | A61J 3/074 53/471 |
| 2008/0184671 | A1 * | 8/2008 | Fleckenstein | B65B 3/003 53/268 |
| 2012/0090268 | A1 * | 4/2012 | Krauss | B65B 3/003 53/281 |
| 2012/0093618 | A1 * | 4/2012 | Monti | A61M 5/008 414/226.01 |
| 2017/0225814 | A1 * | 8/2017 | Eberhardt | B65B 39/12 |

FOREIGN PATENT DOCUMENTS

| | | | |
|---|---|---|---|
| DE | 102009027452 | A1 | 1/2011 |
| DE | 102012208060 | A1 | 11/2013 |
| DE | 102012208061 | A1 | 11/2013 |
| DE | 10345338 | B4 | 8/2015 |
| DE | 102014214693 | A1 | 1/2016 |
| EP | 2441711 | A1 | 4/2012 |
| EP | 2570350 | A1 | 3/2013 |
| WO | 20130164422 | A2 | 11/2013 |
| WO | WO2016012158 | A1 | 1/2016 |

* cited by examiner

DEVICE AND METHOD FOR FILLING NESTED CONTAINERS

CROSS-REFERENCE TO RELATED APPLICATIONS

This application claims the priority of German patent application DE 10 2017 100 010.0, filed Jan. 2, 2017, the entire content of which is hereby incorporated by reference.

FIELD

The present application relates to a device for filling nested containers, the containers being arranged in at least one row in a nest and being conveyable by means of a conveying device, having a filling station for simultaneously filling the containers of one row, having at least one weighing station for weighing a row of containers, having a first gripping device for simultaneously removing a row of containers to be filled and for transferring said containers to a first weighing station of the at least one weighing station and for transferring the weighed containers from the at least one weighing station back into the nest from which the first gripping device has removed the row of containers to be filled, or back into a following nest.

Containers are preferably understood in the present case as pharmaceutical or cosmetic objects such as syringes, vials, cylinder ampoules etc.

The conveying device preferably defines a conveying direction, "in front" or "behind" or "after" being understood in the present case with reference to said conveying direction.

Such a device for filling is preferably arranged within a production line, the containers being prepared for filling in one or multiple preceding steps, that is to say, for example, unpacked and arranged in nests and/or sterilized and/or heated or cooled in order not to impair the product to be filled into the containers. A device for closing the filled containers is preferably connected downstream of the device for filling in the conveying direction. The containers, separated into singles or into groups, can then be packaged preferably in a sterile manner for further conveying to an end consumer.

BACKGROUND

Document DE 103 45 338 B4, shows a conveying system conveying the nested containers in cycles, a gripping device removing a row of containers to be filled from the nest and transferring them to a weighing station, the gripping device transferring the weighed containers after weighing to a filling station, said row then being filled. The gripping device, after filling, transfers said row a second time to the same weighing station, the row of filled containers being weighed again, and the net contents thereof being determined as a result, and the filled row being re-positioned again into the nest and being left out when the nest is filled in order to avoid being filled twice.

In particular in the case of pharmaceutical products, it is relevant to know the precise fill level of the containers as an incorrectly filled container, either an under-filled or an over-filled dosing of a product contained in the container, can have consequences. This can result, on the one hand, in serious harm to health and, on the other hand, in particular in the event of under-dosing, can result in the effectiveness of the product being considerably restricted. In the case of cosmetic products, a high level of accuracy of the fill level of the container is also significant in order to sell the correct quantity of the expensive cosmetic products.

Consequently, controlling and, where applicable, re-adjusting the fill level or the correct operation of a filling device is of particular interest.

In this connection, weighing part of the containers before and after the filling operation and determining the net contents of the individual containers therefrom is known.

It is particularly preferred, in this connection, when said control is able to be carried out during the on-going filling process. In this case, in the prior art said measuring frequently results in delays in the filling operation as the determining of the net contents of the containers requires a certain time.

According to the teaching of document DE 103 45 338 B4, the filling operation has to be interrupted at least in part in order to remove the row of containers, to weigh them, to feed them to the filling station and to fill them, to weigh them again and to reposition them in the nest.

Furthermore, it is possible according to the above-named teaching to weigh only a certain part of the nested containers.

In addition, the filling operation of the checked containers differs from the filling operation of the remaining containers. Consequently, no real checking of the filling operation as carried out in normal operation is possible. Faulty alignment of the filling station with a row of a nest to be filled results in the worst case in a product being poured out next to said row. Such a fault is not detectable using the above-named method.

DE 10 2004 035 061 A1 discloses a device for the dosed filling of vessels situated in groups in receiving means of a carrier plate and said device comprises a weighing device for checking the dosing results of a dosing device, the weighing device comprising a lifting mechanism for lifting at least one of the vessels out of a seat of the carrier plate, the weighing device comprising a lifting mechanism such that the individual vessels only have to be lifted out of the nest in order to be weighed.

In this connection, the same weighing device is used before and after the filling of the individual vessels such that a nest has to be within the reach of the weighing device before the filling and after the filling. In addition, the conveying device has to be stopped during the weighing of the containers and the weighing device has to be at a standstill for a short time. Control weighing is consequently always accompanied by a delay in the filling station.

Document EP 2 570 350 A1 discloses a method for filling and closing pharmaceutical objects which are arranged in parallel rows in nests. The objects, in this case, are removed from the nests in a removal station at an entry to a conveying device and are moved into the conveying device, by means of the conveying device the objects are fed along a straight portion of the conveying path one after another to a first weighing station, a filling station and a second weighing station.

In this connection, the objects are not filled in the nests, but also have to be removed for filling, which results in longer processing times.

Document DE 10 2012 208 060 A1 proposes a filling machine for filling containers with a liquid. The filling machine includes: a handling device, a weighing device, a first filling device and a second filling device, the first filling device being set up to fill containers arranged on the weighing device. In addition, the second filling device is set up to fill containers arranged in a nest. The included handling device is set up, in this case, to move individual containers and/or rows of containers out of the nest to the weighing device. In addition, the handling device can remove the containers out of the weighing device and reposition them in the nest.

In this connection, the containers are filled during the weighing process, which results in complicated control of the filling system and long processing times.

DE 10 2014 214 693 A1 discloses a device for weighing a receptacle, having at least one weighing device for weighing at least one receptacle, at least one receptacle receiving means for conveying the receptacle relative to the weighing device, at least one drive surface and at least one mover which is coupleable on the drive surface being provided, the mover being arranged so as to be displaceable and/or rotatable on the drive surface in at least two degrees of freedom and the receptacle receiving means being arranged on the mover.

In this connection, a mover is provided for conveying the receptacles, as a result of which the filling system is complicated in design and control and is cost-intensive.

It is an object of the present application to provide an improved device and an improved method for filling nested containers, both of which, in particular, enable in-process control of the fill level of the containers.

SUMMARY

According to one aspect of the application, there is provided a device for filling nested containers, wherein the containers are arranged in at least one row in a nest and are conveyable by means of a conveying device, having a filling station for simultaneously filling the containers of one row, having at least one weighing station for weighing a row of containers, having a first gripping device for simultaneously removing a row of containers to be filled and for transferring said containers to a first weighing station of the at least one weighing station and for transferring the weighed containers from the at least one weighing station back into the nest from which the first gripping device has removed the row of containers to be filled, or back into a following nest, having a second gripping device for simultaneously removing a row of filled and weighed containers and for transferring said row of containers to the first weighing station or to a second weighing station of the at least one weighing station and for transferring the row of filled and twice weighed containers from the at least one weighing station back into the nest from which the second gripping device has removed the row of filled containers, or back into a following nest.

According to a further aspect of the application, there is provided a method for filling nested containers, having the steps:

- Removing a row of containers to be filled out of a nest by means of a first gripping device,
- Weighing the individual containers in the empty state,
- Repositioning the empty containers into the nest from which the first gripping device has removed the row of containers to be filled, or into a following nest,
- Filling the weighed containers preferably simultaneously,
- Removing the filled containers out of the nest by means of a second gripping device,
- Anew weighing of the individually weighed and filled containers, and
- Repositioning of the filled containers after the second weighing into the nest or into a following nest.

It is possible as a result of the device and the method to carry out in-process control without, at the same time, intervening in the on-going operation. The filling system preferably keeps running at normal speed. In addition, it is possible to monitor the fill operation, precisely as it is carried out in the on-going operation. It is possible to process all containers with the same time sequence, independent of the arrangement of the containers, in particular independent of the number of rows of containers in a nest or the number of containers in a row. In addition, a complete fill cycle can be checked with the check on an entire row. Any influencing of the fill points amongst themselves can also be excluded in this way.

According to the present application, at least 6% and in particular at least 10% of the containers can be checked in this way; it is, however, also conceivable to check more, additionally all, or fewer containers.

The first and the second gripping devices are preferably designed in a substantially identical manner.

The first and/or the second gripping devices can be realized corresponding to the containers to be weighed. It is, thus, conceivable for the first and/or the second gripping devices to comprise a lifting device which lifts containers, which project downwards out of the nests, such that the gripping device, preferably by means of gripping jaws, can engage the lifted containers.

In the case of correspondingly formed containers, in particular containers with an upper end which is located further outside radially or cylindrically formed containers with a sufficiently large distance between the individual containers, it is possible to dispense with lifting the containers beforehand and to engage the containers directly.

In addition, it is conceivable to provide a gripping device with suction cups, the suction cups being able to be arranged on a smooth surface of the containers in order to fix the containers to the gripping device temporarily by means of negative pressure.

A conveying device is to be understood in the present case as any possible type of device which is suitable for the purpose of conveying nested containers. In this case, it is conceivable for nests of containers to rest on two conveying rails which run in parallel and to be conveyed in this manner. It is also conceivable to insert the nests into a rail provided for this purpose, or to receive the nests in a conveying carriage. In addition, it is possible to convey the nests of containers by means of a belt conveyor or to convey them clamped between at least two conveyor belts.

A nest is to be understood in the present case as any type of device or arrangement which is suitable for the purpose of collecting multiple containers together. The containers, in this case, are preferably arranged in multiple rows. A row, in this connection, can consist of at least two containers.

A weighing station according to the present application can be any type of weighing device which makes it possible to weigh multiple containers individually and substantially in parallel.

According to one configuration, the filling device comprises a control unit which is realized for the purpose of controlling the first and the second gripping devices and the at least one weighing station and of weighing at least 6% of the containers of a nest. As a result, a high standard of quality can be achieved. In particular, at least 10% or precisely 10% of the containers of a nest can be weighed. A list of different nest configurations can be found as an example in the table below.

| Containers per nest | Number per row | Proportion of one row of overall containers of a nest [%] |
|---|---|---|
| 160 | 16 | 10 |
| | 10 | 6.25 |
| 100 | 10 | 10 |
| 64 | 8 | 12.5 |
| 48 | 8 | 16.67 |
| | 6 | 12.5 |
| . . . | . . . | . . . |

In a preferred manner, a row of containers comprises precisely 6.25%, 10%, 12.5% or 16.67% of the containers of a nest. As a result, precisely 6.25%, 10%, 12.5% or 16.67% of the containers of a nest can be gripped and weighed by means of the gripping devices.

In a further preferred manner, a row comprises precisely 10 containers, the first gripping device and/or the second gripping device being realized for the purpose of gripping 10 containers simultaneously. As a result, the speed of the filling system can be further improved.

In the case of such systems, deviations in the filling behaviour from filling operation to filling operation are usually very small to non-existent such that as a result of checking at least 6% and in particular at least 10% of the containers, correct operation of the filling device can be checked or verified with a high degree of reliability.

In one configuration of the filling device, it can be provided that the filling station comprises a plurality of fill points perpendicular to a conveying direction of the nested containers, wherein the number of containers of a row corresponds to the number of fill points of the filling station.

In particular, both the first gripping device and the second gripping device are realized in such a manner that they are each able to grip the entire row of containers simultaneously.

With the checking of an entire row, it is additionally possible to check a complete fill cycle. In this way, it is also possible to exclude the fill points influencing one another.

In one configuration of the filling device, it can additionally be provided that the row of nested containers extends perpendicular to a conveying direction of the nest.

The first gripping device is preferably realized in such a manner that it can reposition containers back into a or the nest in front of or at the filling station. As a result, it can be ensured that the filling process is not disturbed, the filling device can therefore keep running at normal speed regardless of the measuring. By an interruption not being necessary for measuring, the filling device is generally able to run faster. This enables a consistent processing process such that higher precision is able to be obtained. In particular, the process times of the system remain substantially the same such that further process steps, such as, for example, gassifying the containers, can be carried out without being impaired by the weighing process.

It is further preferred when the second gripping device is realized in such a manner that, before the second weighing process, it removes the containers behind the filling station, that is to say preferably between the filling station and a closing station, out of a nest and repositions the containers after the second weighing process into a or the nest behind the filling station and preferably before the closing station. An interruption-free fill sequence can be ensured as a result.

The first weighing station and/or the second weighing station, according to a preferred configuration, comprise a plurality of weighing cells, wherein the number of weighing cells corresponds preferably to at least the number of containers to be weighed, wherein the containers are simultaneously weighable individually. As a result, it is possible to weigh of all the containers to be weighed in a rapid manner, the speed at which the system runs, in this case, depending preferably substantially on the speed of the filling station and not being impaired by the weighing.

According to a further preferred configuration, the first gripping device and/or the second gripping device comprises at least biaxial gripping jaws. As a result, the filling device can be realized in a structurally simple and cost-efficient manner. In addition, simple control of the first gripping device and/or of the second gripping device and short conveying times of the containers to be weighed are possible.

According to a further preferred configuration, the first gripping device and/or the second gripping device is realized in such a manner that it can remove containers, preferably an entire row of containers, out of multiple, in particular all, positions of the nest and is able to reposition them into said or a different position of said or another nest. A very dynamic design of the system is possible as a result. In particular, the system can continue to be run during the weighing process as the row can also be repositioned independently of the position of the nest.

It is further preferred when that the first gripping device and/or the second gripping device comprises gripping jaws with two clamping strips in order to clamp a row of containers. Removal of a row of containers can be achieved in a structurally simple manner as a result.

According to a preferred configuration of the method, the net contents of each individual container is determined from the result of the first weighing and the result of the second weighing, wherein the filling station is adapted individually with regard to the determined net contents of each container. Automated readjustment of the fill quantity is possible as a result, which allows for adaptation and self-correction of the filling device without stopping the fill operation.

This is particularly advantageous in the case of very critical products which have to be, for example, cooled or filled in a protected atmosphere. A protracted adjusting of the filling system by hand is not necessary, the system is calibrated quasi according to the learning process, that is to say according to the first determining of the net contents.

The terms filling the containers and closing the containers are to be understood in the present case in such a manner that they can also include a filling or closing with a gassifying of the containers included.

It is obvious that the features named above and the features yet to be explained below are usable not only in the combination provided in each case, but also in other combinations or standing alone without departing from the framework of the present invention.

BRIEF DESCRIPTION OF THE SEVERAL VIEWS OF THE DRAWING

Configurations of the device are shown in the drawings and are explained in more detail in the following description, in which.

DETAILED DESCRIPTION

Figure 1:
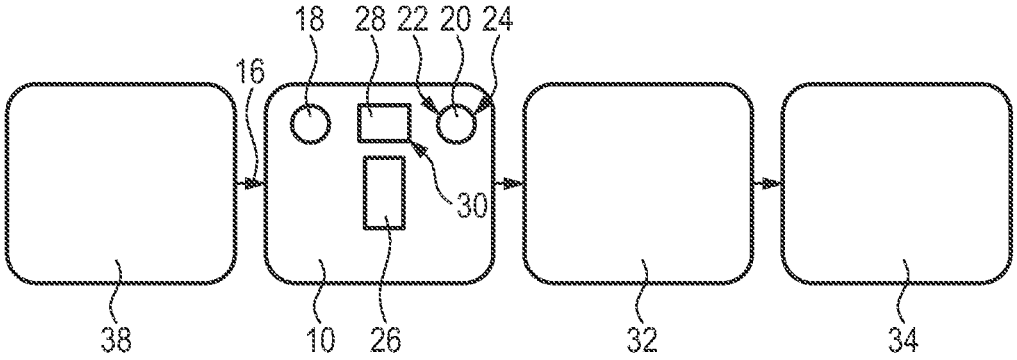
FIG. 1 shows a schematic representation of a configuration of a filling station in a production line.

FIG. 1 shows a schematic representation of a filling device 10 in a production line for filling nests 12 of containers 14 which, for reasons of clarity, are not shown further in FIG. 1. The nests 12, in this case, are conveyed in the direction of the arrow by a conveying device 16 which is symbolized in a simplified manner by arrows. The filling device 10 comprises, schematically represented, a first gripping device 18 and a second gripping device 20 which each comprise a pivot arm 22 and gripping jaws 24. In addition, the filling device 10 comprises a filling station 26 and at least one weighing station 28 with weighing cells 30 which are not shown in any more detail. A closing station 32 for closing the containers 14 is arranged downstream of the filling device 10 in the conveying direction, a packing station 34, in which the containers 14 can be removed from the nests 12 and packaged in corresponding receptacles, such as boxes, for onward conveying, preferably following said closing station. It is obvious that the containers 14 can also remain in the nests 12 and can be packaged together with the nests 12. An upstream device 38, in which the containers 14 are prepared for filling, that is say, for example, are unpacked and arranged in the nests 12 and/or sterilized and/or heated or cooled in order not to impair the product to be filled into the containers 14, can be provided in the conveying direction before the filling device 10.

Figure 2A:
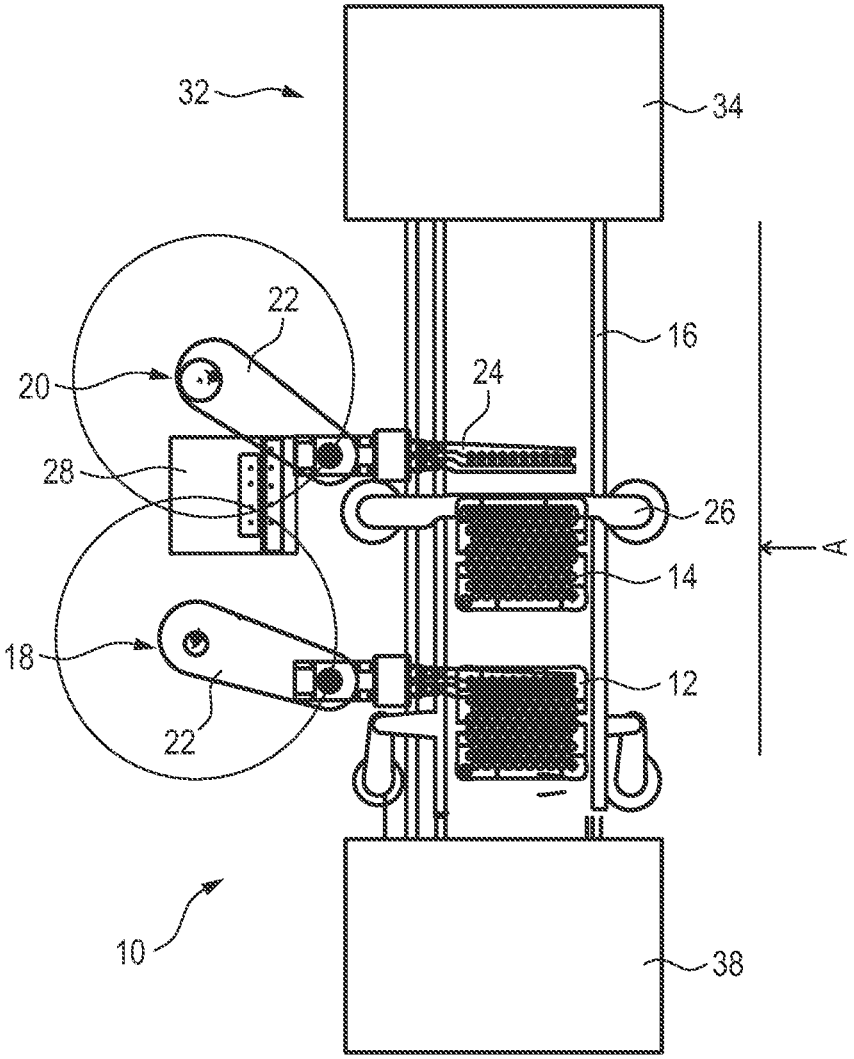
FIG. 2*a* shows a schematic top view of a configuration of a filling station.

FIG. 2*a* shows a configuration of a filling device 10. Nests 12 of containers 14 are fed to the filling device 10 by means of a conveying device or transporting device 16. The filling device 10 further comprises a first gripping device 18 and a second gripping device 20. The first gripping device 18 and the second gripping device 20 are designed substantially identically such that only the first gripping device 18 is described in more detail below. The movement radii of the gripping devices are shown schematically as circles.

The first gripping device 18 comprises a pivot arm 22, on which gripping jaws 24, which are pivotable in turn, are arranged. The first gripping device 18, in this case, is arranged before a filling station 26 in the conveying direction. A weighing station 28 is arranged in the conveying direction between the first gripping device 18 and the second gripping device 20. The weighing station 28 comprises individual weighing cells 30. The weighing cells 30 can be configured, for example, as weighing cups.

The weighing station 28 is situated therefore with reference to the conveying direction substantially at the same level as the filling station 26. A closing station 32, which for reasons of clarity is shown purely schematically together with further downstream devices 34, is preferably arranged behind the second gripping device 20 in the conveying direction.

The first gripping device 18 serves for removing a row of containers 14 out of a nest 12 and for transferring them to the weighing station 28, each weighing cell 30 of the weighing station 28 preferably having associated therewith a container 14 such that the containers 14 are weighed substantially in parallel and individually. After the weighing, the containers 14 are picked up again by the first gripping device 18 and are repositioned into the nest 12. The empty weight of the individual containers 14 can be registered in this connection.

The nest 12 is then conveyed by means of the conveying or transporting device 16 in a conveying direction to the filling station 26, the filling station 26 being able to fill the containers 14 of a row of containers 14 in parallel and individually. A row of containers extends, in this case, perpendicular to the conveying device. The containers stand side by side in the nest perpendicular to the conveying direction.

The filling of the containers 14 occurs at fill points of the filling station 26. The fill points can also be arranged side by side perpendicular to the conveying direction. The filling is effected, for example, by means of so-called filling needles and is generally known in the prior art such that further details with reference to the precise filling operation are omitted.

After filling, the row of pre-weighed containers 14 can be removed by the second gripping device 20 and once again fed to the weighing station 28. The individually filled containers 14 can then be weighed once again as described above. In this connection, the net contents of each individual container 14 can be determined from the previously determined empty weight and the overall weight and checked. The result of the net contents can be taken into account in the control of the filling station 26.

The above-described filling device 10 is preferably only a part portion of a fully automated system, devices that are required to provide the containers 14 in the nests 12 being connected upstream of the filling device 10 and are shown schematically in the present case by the symbol with the reference sign 38.

Figure 2B:
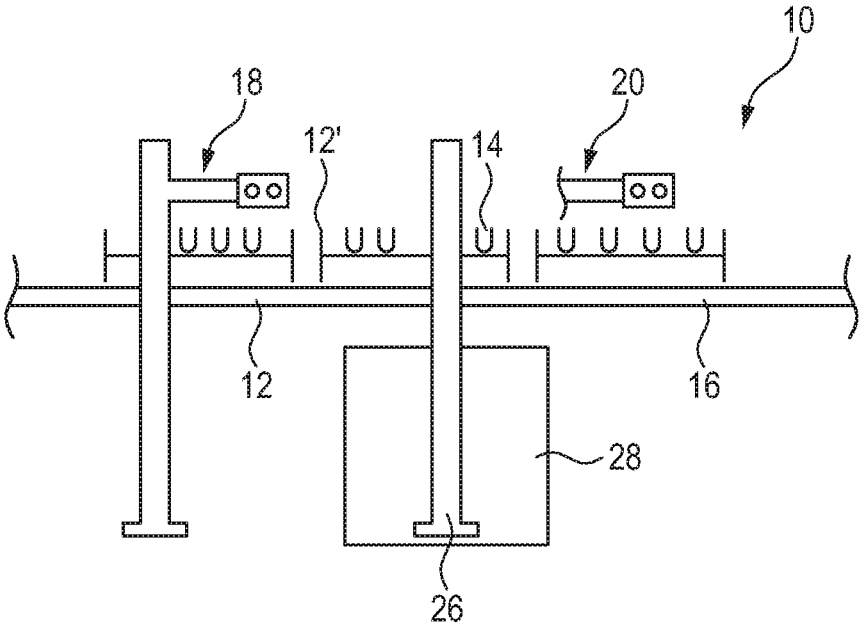
FIG. 2*b* shows a schematic side view of the filling station of FIG. 2*a*.

FIG. 2*b* shows a highly simplified representation of the filling device 10 of FIG. 2*a* along the section A. The conveying device runs, in this case, from left to right. The rows of containers 14, in this case, are shown in a simplified manner as U-shapes. As the first gripping device 18 is structurally identical to the second gripping device 20, the second gripping device 20 is only indicated schematically. Further shown is a total of three nests 12, each with four rows of containers 14, one row of containers 14 being hidden by the filling station 26 in the middle nest 12'.

Figure 3A:
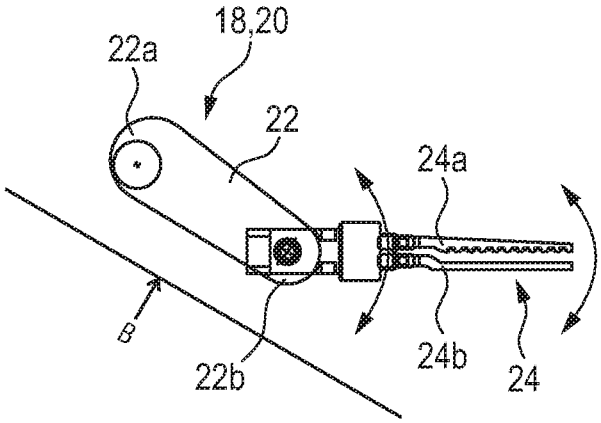
FIG. 3*a* shows a schematic top view of a gripping device.

FIG. 3*a* shows a gripping device 18, 20. The gripping device 18, 20 comprises a pivot arm 22 which is pivotable about a first end 22*a*, as indicated by an arrow in FIG. 3*a*. Gripping jaws 24 are arranged on a second end 22*b* of the pivot arm 22, which is located opposite the first end. Said gripping jaws are arranged on the second end 22*b* of the pivot arm 22 and are, as illustrated by an arrow, pivotable. The gripping jaws comprise a first clamping strip 24*a* and a second clamping strip 24*b*, both of which are movable with reference to one another in such a manner that they can clamp or release a row of containers 14.

Figure 3B:
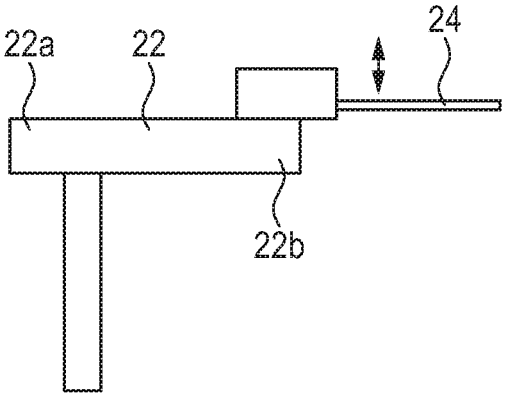
FIG. 3*b* shows a schematic side view of the gripping device of FIG. 3*a*.

FIG. 3*b* shows a schematic representation of a section of the gripping device of FIG. 3*a* along the section B. The gripping jaws 24 are configured in such a manner that they can be moved upward and downward, that is to say perpendicular, with reference to the conveying direction in order to remove the containers 14, which are clamped in the first clamping strip 24*a* and the second clamping strip 24*b*, out of a nest 12.

Figure 4:
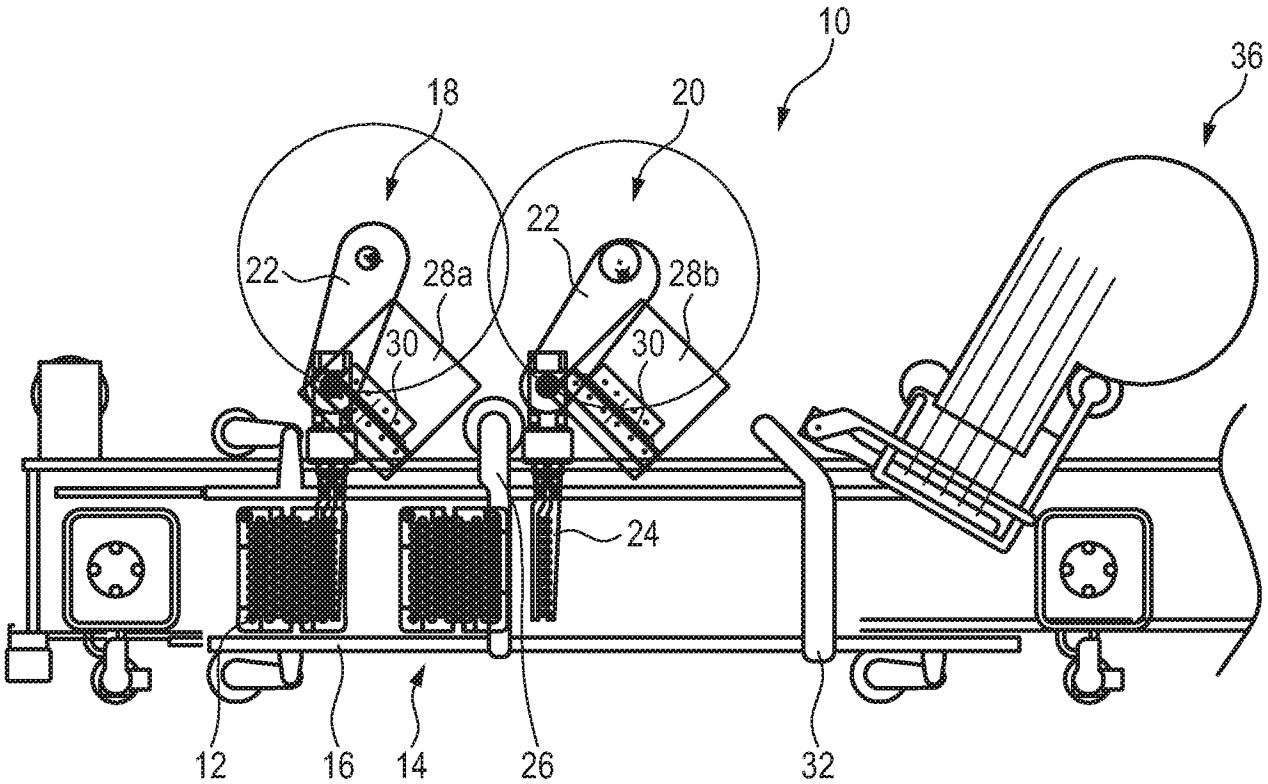
FIG. 4 shows a schematic top view of a filling device in a filling system.

FIG. 4 shows a top view of a filling device 10 with a closing station 32 with a closing means station 36 connected thereto. The filling device 10 in FIG. 4 corresponds substantially to the filling device 10 in FIGS. 2*a* and 2*b* such that identical components are characterized with identical reference signs. The differences are to be explained in more detail below.

The filling device 10 comprises a first weighing station 28*a* and a second weighing station 28*b*. The first gripping device 18 can remove a row of containers 14 out of a nest 12 and transfer them to the first weighing station 28*a*. The first weighing station 28 can then determine the empty weight of the individual containers 14 in parallel, as described above. The first gripping device 18 can then, after the weighing of the containers 14, remove the row of containers 14 from the first weighing station 28*a* and reposition them into the nest 12. The nest 12 is then conveyed further by means of the conveying device 16 and fed to the filling station 26, in which the containers 14 of each row are filled individually, each row being filled in parallel. After the filling process, the nest 12 is then moved further in the conveying direction by means of the conveying device 16, the previously weighed row of containers 14 being able to be removed by the second gripping device 20 and being able to be fed to the second weighing station 28*b*, the second weighing station 28*b* weighing the containers 14 individually and in parallel, and it being possible to determine the net contents of the containers 14 from the empty weight, that is to say from the result of the previous weighing, and from the overall weight, that is to say the result of the new weighing. Said net contents can then be taken into account in the control of the filling station 26. In particular, the filling station 26 can be adjusted or re-adjusted as a result.

After the new weighing, the second gripping device 20 can remove the row of containers 14 out of the second weighing station 28*b* and reposition them into the nest 12. The nest 12 is then moved further in the conveying direction by means of the conveying device 16 and is fed to a closing station 32 in which the containers 14 are closed preferably individually and in parallel. Closing means of a feeding device 36 are made available, in this case, to the closing station 32.

The closed, filled and twice weighed containers 14 can then be submitted first of all to an inspection, can be cooled or stored in a quarantine area and then labelled and fed to a packaging device which is not designated in any detail. The containers 14 are packaged in various pack sizes corresponding to an end consumer and are then prepared for further transport/dispatch.

Figure 5:
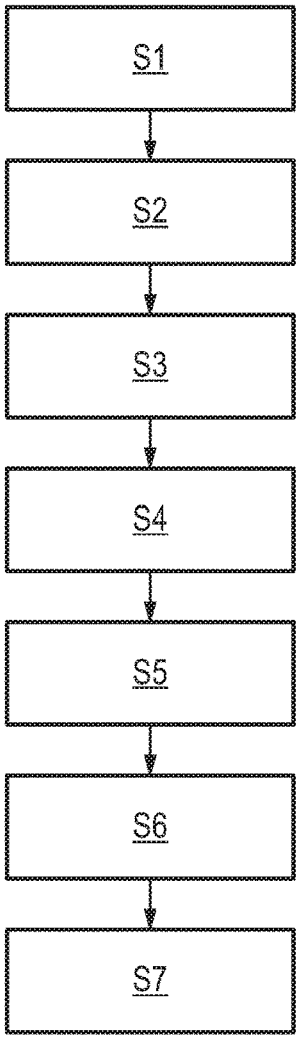
FIG. 5 shows a configuration of a method.

FIG. 5 shows a schematic representation of the individual method steps of a method according to the invention. The method can preferably be carried out by one of the above-described filling devices 10. In a first step S1, the containers 14 to be filled are removed from a nest 12 by means of a first gripping device 18. In a second step S2, the individual containers 14 are weighed empty and the empty weight thereof is determined. In a following step S3, the empty weighed containers 14 are placed back into the nest 12 or into a nest 12'. In the following step S4, the empty and weighed containers situated in the nest 12 are filled by the filling station 26 and then in a step S5 are removed out of the nest 12 by means of a second gripping device 20. In a following step S6, the once weighed, filled containers 14 are weighed again and finally in a step S7 are placed back into the nest 12 or into a different nest 12'.

In the case of the method the containers 14 are weighed individually, that is to say the weight of each individual container 14 is determined, the containers 14 also being weighed substantially simultaneously.

With the method, it is possible to weigh at least 6%, in particular precisely 10%, of all the containers 14 before and after the filling operation. It is obviously also conceivable to weigh more containers 14, in particular all the containers 14, before and after the filling operation.

In particular, as a result of weighing the containers 14 twice, the net contents of the individual containers 14 can be determined, said net contents being able to be taken into account preferably in the control of the filling station 26 such that an automatic adjustment to the filling station 26 is able to be carried out.

The filling station 26 preferably comprises individual filling devices or fill points which can each fill one container 14 such that the filling station 26 can preferably fill one row of containers 14 substantially simultaneously. It is also conceivable for the filling station 26 to comprise fewer or more filling devices.

FIGS. 6*a* to 6*d* show various configurations of the present method. For reasons of clarity, the conveying device 16 and the filling station 26, among other things, are not shown. In said example, the conveying direction of the nests 12 of containers 14 runs from bottom to top.

Figure 6A:
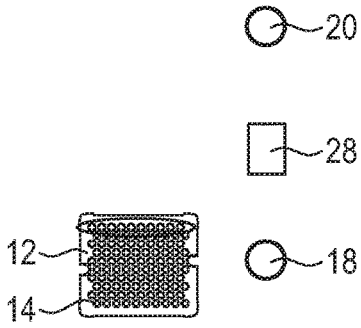
FIGS. 6*a* to 6*d* show a simplified representation of various removal, weighing and repositioning steps.
Figure 6B:
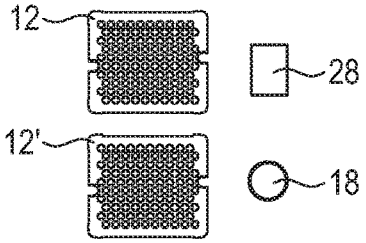

FIG. 6*a* shows a schematic representation of a nest 12 with containers 14, a row of containers 14 being able to be removed by the first gripping device 18. This can be, for example, the first row of containers 14, as shown by a border in FIG. 6. It is obvious that each arbitrary row can be removed by the gripping device 18. Said row of containers 14, in this case, as described above, is clamped by the jaws 24 of the first gripping device 18, lifted out of the nest 12 and transferred to the at least one weighing station 28 and is weighed. The weighed containers 14 can then be removed out of the at least one weighing station 28 by the first gripping device 18 and transferred into the nest 12 or into a following nest 12' as shown in FIG. 6*b*. The filling of the containers 14 in the filling station 26, which is not shown in any detail, is then effected as described above.

Figure 6C:
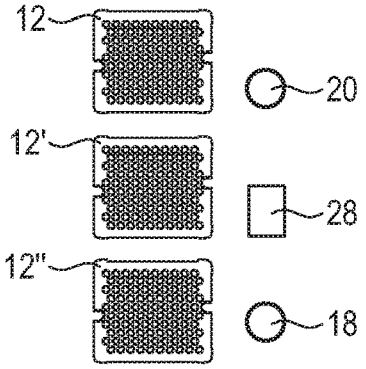
Figure 6D:
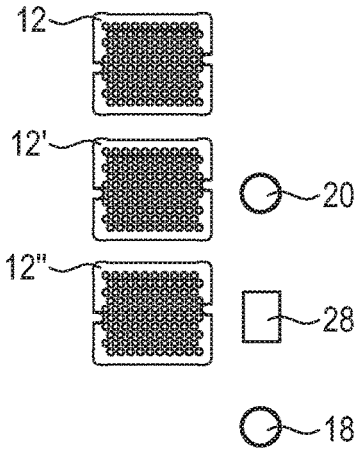

As shown in FIG. 6*c*, once the containers 14 have been filled, the second gripping device 20 removes a row of already weighed and filled containers 14 out of the nest 12 and transfers said row, as described above, to the at least one weighing station 28, the containers 14 being weighed again and then being transferred again back into the nest 12 or into the following nest 12' by the second gripping device 20.

If, after the weighing, the first gripping device 18 has transferred the containers 14 into the nest 12', the second gripping device 20 then removes a row of already weighed and filled containers 14 out of the nest 12' and, after the weighing, transfers said row back again into the nest 12' or into the following nest 12". This is shown schematically in FIG. 6*d*.

In a preferred manner, in this case, at least one row of containers 14 of a nest 12 is weighed before and after the filling process, one row, for example, corresponding to at least 6% and in particular at least 10% of the containers 14 of a nest 12.

Configurations are also conceivable where a row of containers 14 corresponds to less than 10% and in particular to less than 6% of the containers 14 of a nest 12, in this connection at least as many rows of containers 14 of a nest 12 being weighed before and after the filling process such that, overall, at least the desired proportion of containers 14 of a nest 12 are weighed before and after the filling process.

The number of removed containers 14 corresponds in a preferred manner to the number of fill points in the filling station 26 such that a complete filling cycle can be checked. The influencing of fill points amongst themselves can consequently be checked or excluded.

In a preferred manner, when the system is started up, each row of a first nest 12 is weighed such that the system can be quickly learnt. The system can be put into operation with little time and product loss.

In addition, when emptying the system, in a preferred manner each row of the last nest 12 and possibly of the penultimate nest 12 is weighed such that a check can be run to ascertain up to which row and in particular up to which container 14 of a row the required fill level is obtained. Product loss when emptying the system can be minimized as a result.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A device for filling nested containers, wherein the containers are arranged in at least one row in a nest and are conveyable by a conveying device, the device comprises:

a filling station for simultaneously filling the containers of one row;

at least one weighing station for weighing the containers of the one row;

a first gripping device for simultaneously removing the containers of the one row to be filled and for transferring the containers of the one row to a first weighing station of the at least one weighing station and for transferring weighed containers of the one row from the at least one weighing station back into the nest from which the first gripping device removed the containers of the one row to be filled; and a second gripping device for simultaneously removing filled and weighed containers of the one row and for transferring the filled and weighed containers to the first weighing station or to a second weighing station of the at least one weighing station and for transferring filled and twice weighed containers of the one row from the at least one weighing station back into the nest from which the second gripping device removed the filled and weighed containers.

2. The device according to claim 1, wherein a control unit controls the first gripping device, the second gripping device and the at least one weighing station, and is configured for the purpose of weighing at least 6% of the containers of the nest.

3. The device according to claim 1, wherein the containers of the one row corresponds to at least 6% of the containers of the nest.

4. The device according to claim 1, wherein the one row comprises precisely ten containers, and the first gripping device and/or the second gripping device is arranged for the purpose of gripping ten containers simultaneously.

5. The device according to claim 1, wherein the filling station comprises a plurality of fill points perpendicular to a conveying direction of the nested containers, wherein the number of containers of the one row corresponds to the number of fill points of the filling station, and wherein both the first gripping device and the second gripping device are arranged in such a manner that they are each able to grip the entire one row of containers simultaneously.

6. The device according to claim 1, wherein the one row of containers extends perpendicular to a conveying direction of the nest.

7. The device according to claim 1, wherein the first gripping device is arranged in such a manner that it repositions the weighed containers of the one row in front of or at the filling station.

8. The device according to claim 1, wherein the second gripping device is arranged in such a manner that, before the second weighing, the second gripping device removes the filled and weighed containers of the one row behind the filling station out of the nest and repositions the filled and weighed containers behind the filling station into the nest.

9. The device according to claim 1, wherein the first weighing station and/or the second weighing station of the at least one weighing station comprises a plurality of weighing cells, wherein the number of weighing cells corresponds to at least the number of containers to be weighed, wherein the containers are weighable individually simultaneously.

10. The device according to claim 1, wherein the first gripping device and/or the second gripping device comprises at least biaxial gripping jaws.

11. The device according to claim 1, wherein the first gripping device and/or the second gripping device is arranged in such a manner that it can remove the containers of the one row out of any position of the nest and is able to reposition the containers of the one row into the same or a different position of the nest.

12. The device according to claim 1, wherein the first gripping device and/or the second gripping device comprises gripping jaws with two clamping strips in order to clamp the containers of the one row.

13. A method for filling nested containers, comprising the following steps:

removing a row of containers to be filled out of a nest with a first gripping device;

weighing the individual containers in an empty state so that they are weighed containers;

repositioning the weighed containers into the nest from which the first gripping device removed the row of containers to be filled;

filling the weighed containers so that they are filled and weighed containers;

removing the filled and weighed containers out of the nest with a second gripping device;

individually re-weighing the filled and weighed containers so that they are filled and twice weighed containers; and repositioning the filled and twice weighed containers after the re-weighing into the nest from which the second gripping device removed the filled and weighed containers.

14. The method according to claim 13, wherein the individual containers are weighed simultaneously.

15. The method according to claim 13, wherein at least 6% of all the containers of the nest are weighed before and after the filling process.

16. The method according to claim 13, wherein net contents of each individual container is determined from the result of the weighing and the result of the re-weighing.

17. The method according to claim 16, wherein a filling quantity of a filling station is adapted with regard to the determined net contents of each container.

18. A device for filling nested containers, wherein the containers are arranged in at least one row in a nest and are conveyable by a conveying device, the device comprises:

a filling station for simultaneously filling the containers of one row;

at least one weighing station for weighing the containers of the one row;

a first gripping device for simultaneously removing the containers of the one row to be filled and for transferring the containers of the one row to a first weighing station of the at least one weighing station and for transferring weighed containers of the one row from the at least one weighing station back into a first following nest following the nest from which the first gripping device removed of containers of the one row to be filled; and a second gripping device for simultaneously removing of filled and weighed containers of the one row and for transferring the filled and weighed containers to the first weighing station or to a second weighing station of the at least one weighing station and for transferring filled and twice weighed containers of the one row from the at least one weighing station back into a second following nest following the first following nest from which the second gripping device removed the filled and weighed containers.

19. A method for filling nested containers, comprising the following steps:

removing a row of containers to be filled out of a nest with a first gripping device;

weighing the individual containers in an empty state so that they are weighed containers;

repositioning the weighed containers into a first following nest following the nest from which the first gripping device removed the row of containers to be filled;

filling the weighed containers so that they are filled and weighed containers;

removing the filled and weighed containers out of the first following nest with a second gripping device;

individually re-weighing the and weighed containers so that they are filled and twice weighed containers; and repositioning the filled and twice weighed containers after the re-weighing weighing into a second following nest following the first following nest from which the second gripping device removed the filled and weighed containers.

* * * * *